US007007944B1

(12) United States Patent
Dobbertin et al.

(10) Patent No.: US 7,007,944 B1
(45) Date of Patent: Mar. 7, 2006

(54) PULSED AIRKNIFE CONTROL FOR A VACUUM CORRUGATED FEED SUPPLY

(75) Inventors: Michael T. Dobbertin, Honeoye, NY (US); Henry P. Mitchell, Jr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 241 days.

(21) Appl. No.: 09/688,001

(22) Filed: Oct. 14, 2000

(51) Int. Cl.
*B65H 3/14* (2006.01)

(52) U.S. Cl. ..... 271/98

(58) Field of Classification Search ..... 271/94, 271/96, 98, 108, 105
See application file for complete search history.

(56) References Cited

U.S. PATENT DOCUMENTS 4,699,369 A 10/1987 Zirilli
5,344,133 A * 9/1994 Jantsch et al. ..... 271/94
5,478,066 A * 12/1995 Yoshida et al. ..... 271/94
5,634,634 A 6/1997 Dobbertin
5,645,274 A 7/1997 Ubayashi
6,082,728 A * 7/2000 Ubayashi ..... 271/108
6,120,016 A * 9/2000 Watkiss ..... 271/106

FOREIGN PATENT DOCUMENTS

EP 0 598 272 A 5/1994
EP 1 127 818 A 8/2001
JP 05 286596 A 11/1993
WO WO 96 00631 A 1/1996

* cited by examiner

*Primary Examiner*—David H. Bollinger

(57) ABSTRACT

A method of operating a vacuum corrugated belt feeder with positive air pressure-separator during a feed cycle wherein the vacuum and the positive pressure air are controlled by a vacuum valve and a positive air pressure valve respectively, wherein the paper is taken away by a belt which is activated when a feed clutch is energized, comprising actuating the vacuum at the start of the feed cycle and de-actuated the vacuum when the feed clutch is de-energized, and pulsing the positive air pressure separator by actuating and de-actuating the positive air pressure separator during the feed cycle.

5 Claims, 5 Drawing Sheets

PULSED AIRKNIFE CONTROL FOR A VACUUM CORRUGATED FEED SUPPLY

BACKGROUND

The present invention is in the field of printers and copiers. More specifically this invention relates to a receiver sheet supply and feed apparatus, including a vacuum corrugated feeder, and a positive air pressure separator on such printers and copiers. This invention is useful for the apparatus described by the U.S. Pat. No. 5,344,133 "Vacuum belt feeder having a positive air pressure separator and method of using a vacuum belt feeder" by Jantsch et al, which patent is hereby incorporated by reference in its entirety. The incorporated patent refers to a vacuum, a first positive air supply, and a second positive air supply. The first and second positive air supplies are used simultaneously and will herein be referred to collectively as the airknife.

In typical reproduction apparatus such as copiers or printers, information is reproduced on individual cut sheets of receiver material such as plain bond paper or transparencies. Such receiver sheets are stored in a stack and fed individually when copies are to be produced. The sheet feeder for the reproduction apparatus must be able to handle a wide range of sheet types and sizes reliably and without damage. Sheets must be fed individually, without misfeeds or multi-feeds.

In the vacuum corrugated belt feeder disclosed in the above patent, both the vacuum and the positive air pressure are controlled by valves. During the feed cycle, the positive air pressure valve is continuously open. The vacuum valve is opened to acquire the top sheet off the stack. After approximately 220 milliseconds (for a 110 pages per minute (ppm) feed rate), the clutch is actuated, which drives the feed belts to advance the sheet into the constantly rotating take away rollers. At a time after the lead edge of the sheet has reached the take away rollers, prior to the trail edge of the sheet reaching the edge of the ports in the vacuum plenum, the vacuum and the clutch are turned off.

The airknife airflow and velocity during the acquisition phase must be great enough to fluff the stack and pre-separate the top sheet. During the transport phase, the flow from the airknife must be high enough to create the air bearing between the sheet being fed, and the rest of the stack. However, flow that is too high during the transport phase has several undesirable effects. For example, if the flow is too high there is an increased tendency for the sheets below the top sheet to be blown back away from the lead edge. This is especially troublesome for sheets that do not have a continuous trail edge. Also, the air can deflect the lead edge of sheets with low stiffness, especially if the paper curl is down (lead edge away from the feed belts), which can lead to paper damage or jamming. The flow must not be so great as to levitate any sheets below the sheet being fed above the mechanical gate fingers along the lead edge of the paper drawer, or high enough to cause the second sheet to contact the top sheet when it is being transported off the stack. Also, if the flow is too great, it can cause the trail edge of the sheet being fed to flutter violently, which can in turn contact the sheet below it, tending to drive it forward also.

Typically, the minimum airflow of the airknife is dictated by the acquisition and separation needs and the maximum airflow of the airknife is limited by the transport phase. A method of operation is desired which will optimize the usefulness of the airknife during the acquisition and separation phase, while minimizing the detriments of the airknife during the transport phase.

SUMMARY OF THE INVENTION

A method of operating a vacuum corrugated belt feeder with positive air pressure separator during a feed cycle wherein the vacuum and the positive pressure air are controlled by a vacuum valve and a positive air pressure valve respectively, wherein the paper is taken away by a belt which is activated when a feed clutch is energized, comprising actuating the vacuum at the start of the feed cycle and de-actuating the vacuum when the feed clutch is de-energized, and pulsing the positive air pressure separator by actuating and de-actuating the positive air pressure separator during the feed cycle.

DETAILED DESCRIPTION

The U.S. Pat. No. 5,344,133 "Vacuum belt feeder having a positive air pressure separator and method of using a vacuum belt feeder" by Jantsch et al, describes an apparatus which uses both vacuum and positive pressure air pressure to separate and acquire the top sheet of a supply stack. In this invention, both the vacuum line and the positive air pressure line are routed through valves, which valves are used to control the flow of vacuum and positive air. During typical operation of a printer/copier which uses the apparatus described in U.S. Pat. No. 5,344,133, both the vacuum valve and the positive air pressure valve are open during the feed cycle, and closed when the printer/copier is not feeding from that particular supply.

Following is a detailed description of the drawings which show the vacuum belt feeder with positive air pressure separator as described in U.S. Pat. No. 5,344,133. Although this system is described in detail, the present invention is not limited to use in this particular system. Any printer/copier which uses a combination of vacuum and positive air pressure to lift and separate the top sheets from a feed stack may make use of this invention.

The detailed description is written to a top feed vacuum corrugated feed device, but the present invention is also useful for a bottom feed vacuum belt feed device. In the case of a bottom feed device, instead of separating the top sheet, the vacuum with the airknife would be separating the bottom sheet.

Figure 1:
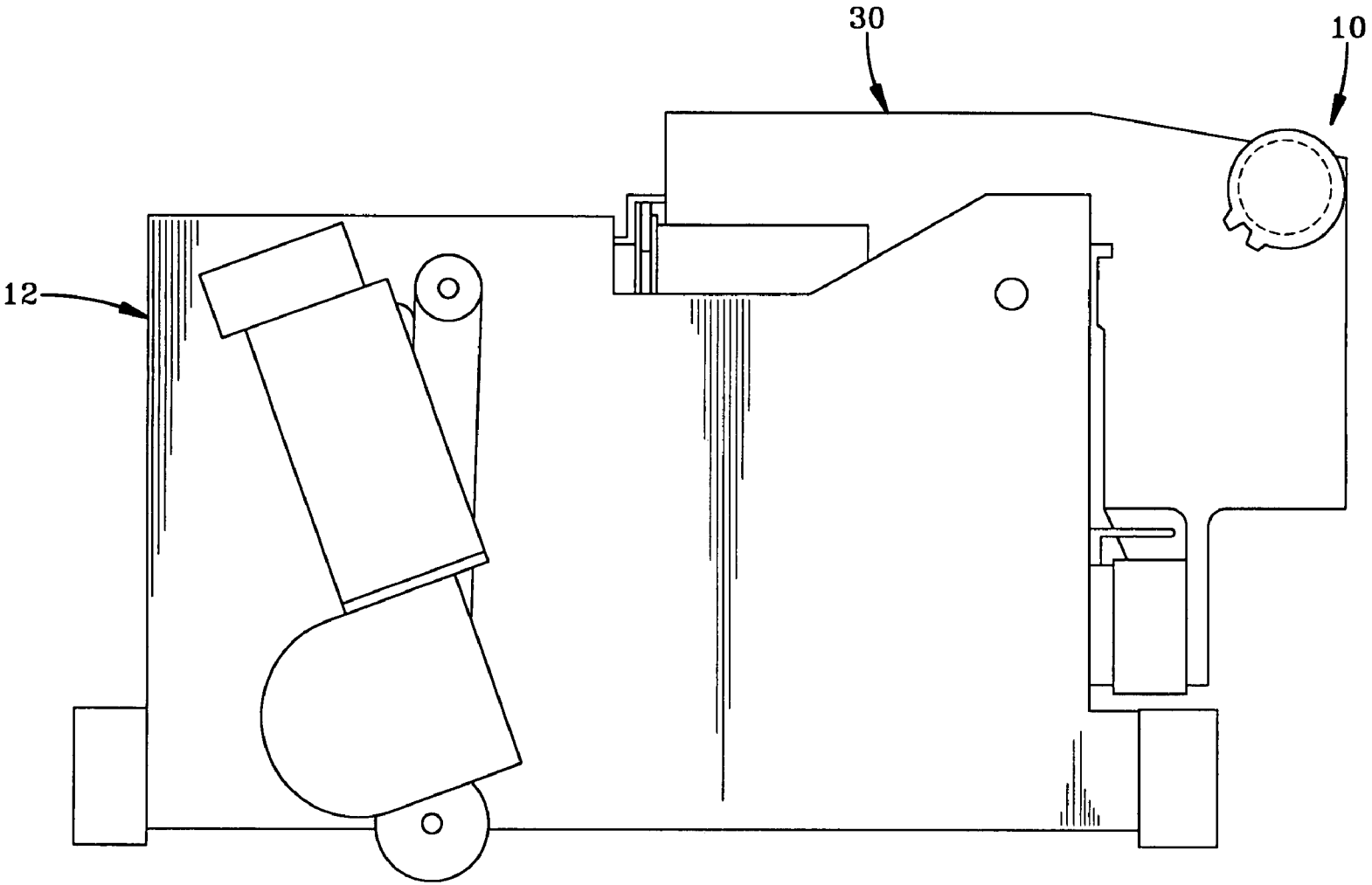
FIG. 1 is a side view of a receiver sheet supply and feeding apparatus.
Figure 2:
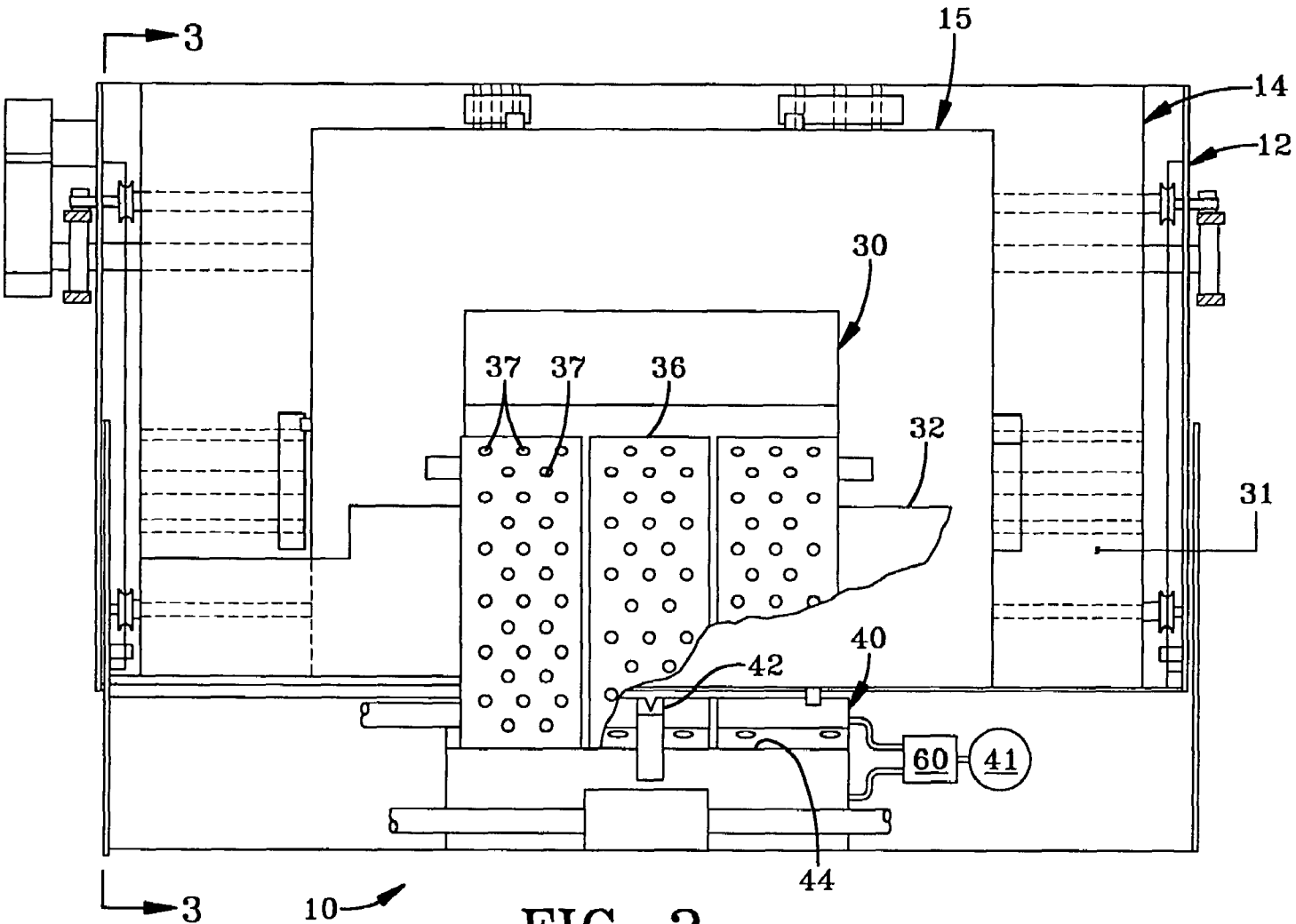
FIG. 2 is a top plan view of a receiver sheet supply and feeding apparatus of FIG. 1 with portions removed or broken away to facilitate viewing
Figure 3:
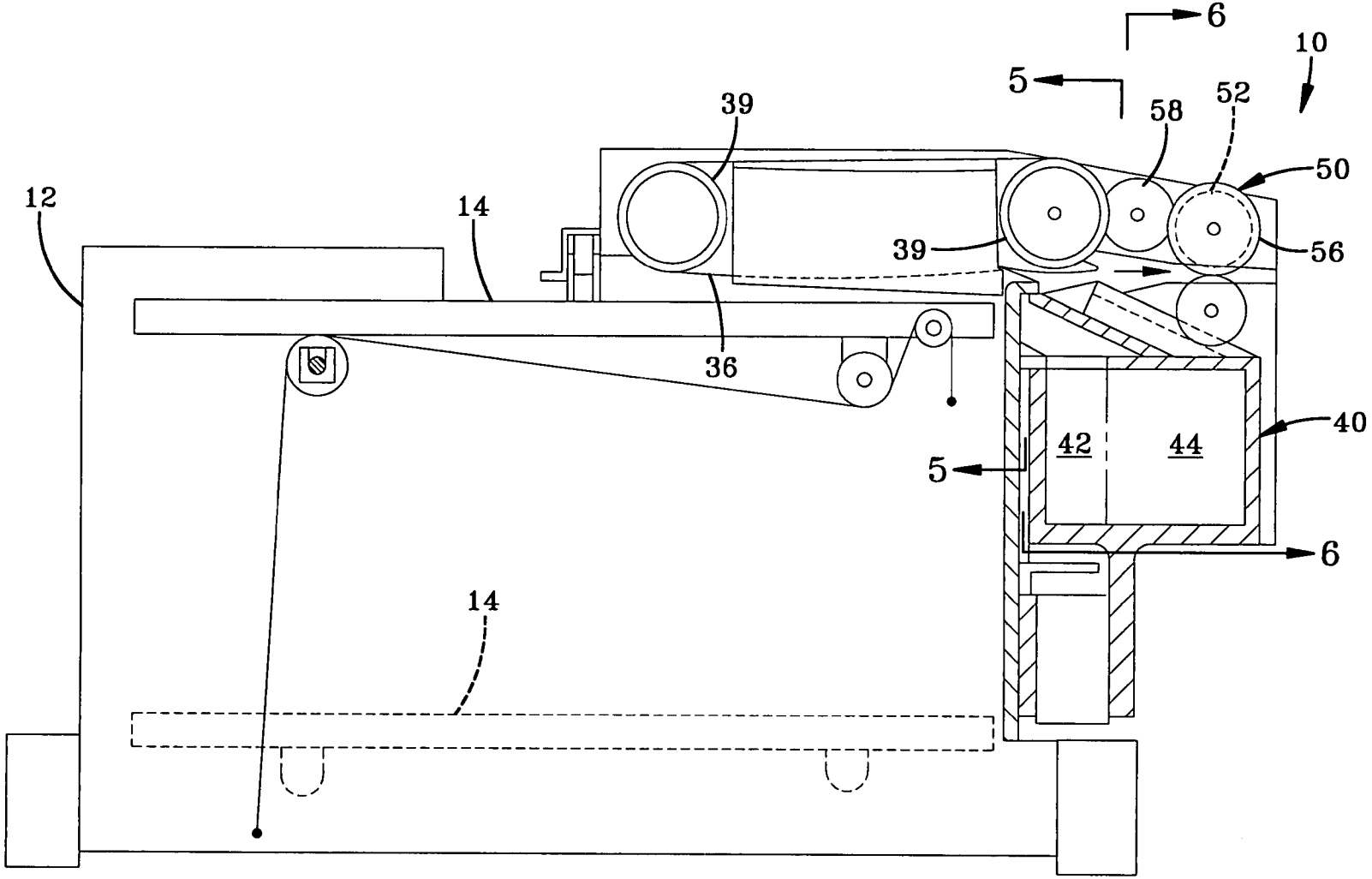
FIG. 3 is a side view of a cross-section of a receiver sheet supply and feeding apparatus taken along lines 3—3 of FIG. 2.
Figure 4:
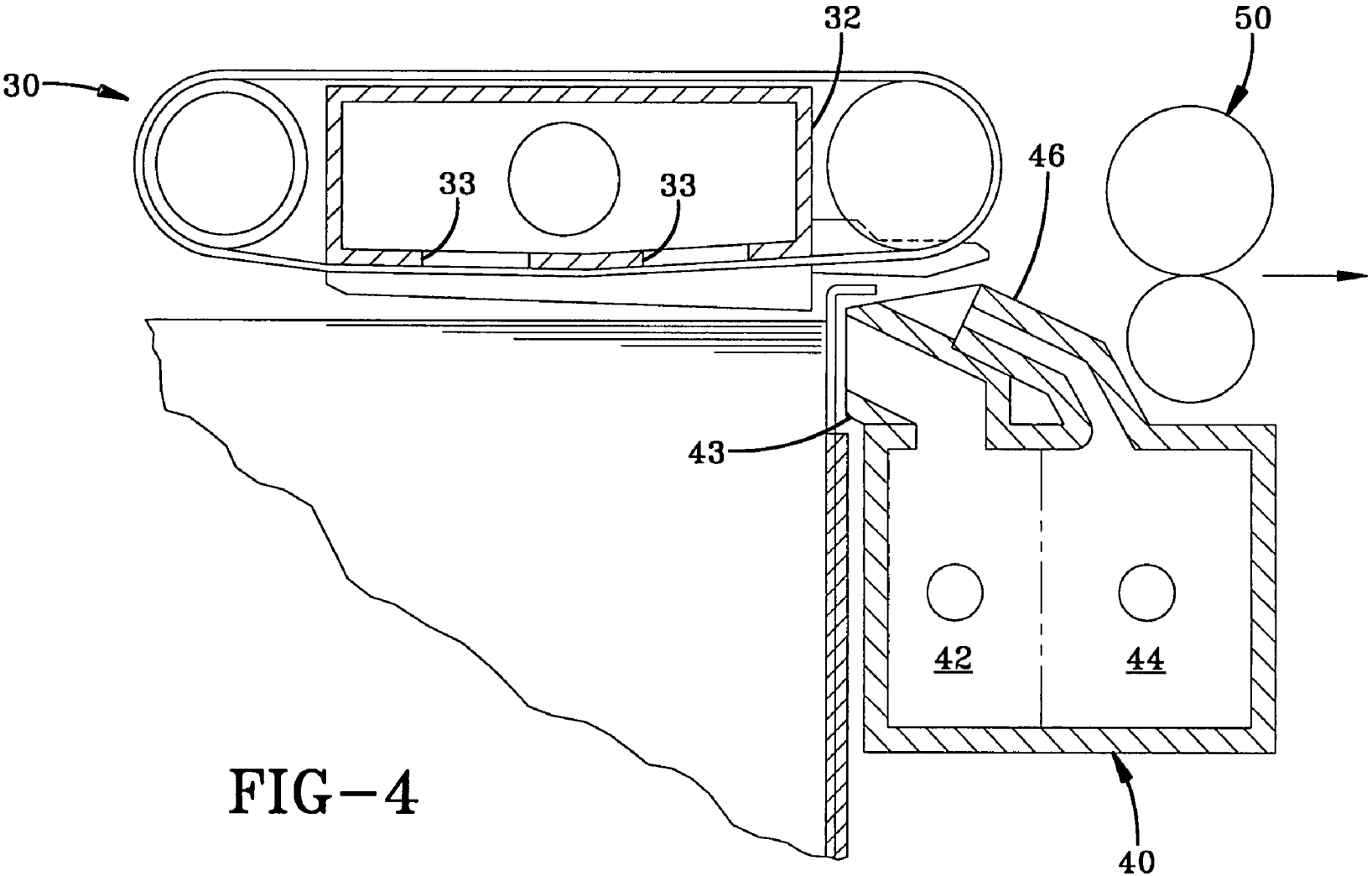
FIG. 4 is a side cross-sectional view of a portion of a receiver sheet supply and feeding apparatus.
Figure 5:
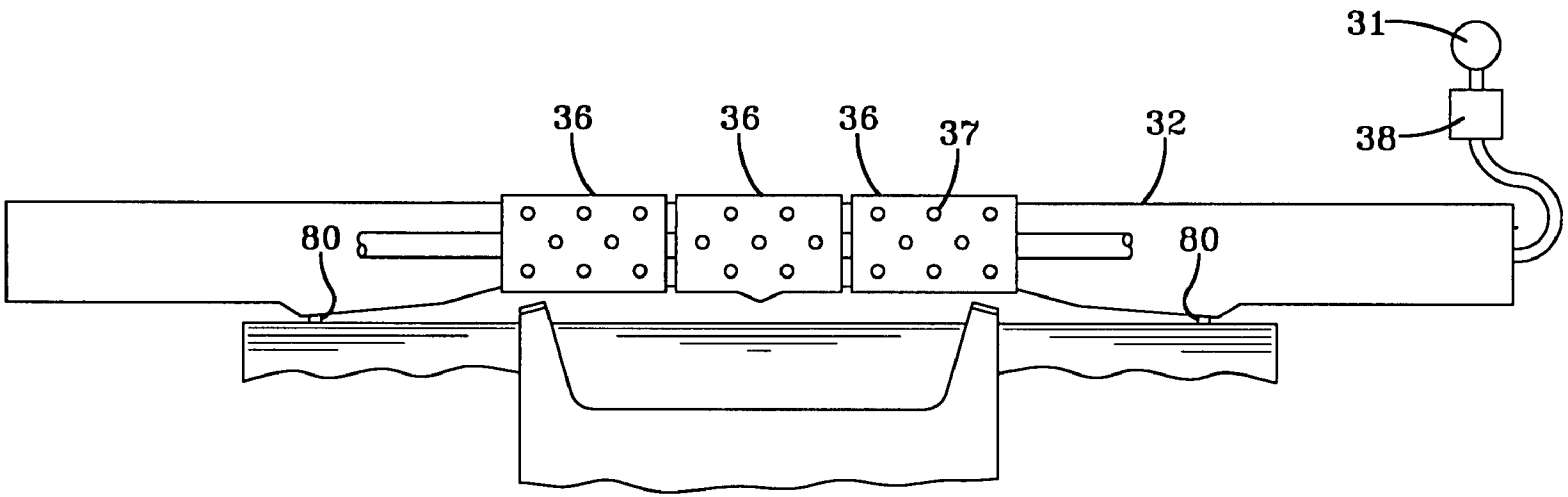
FIG. 5 is an end view of a portion of the receiver sheet supply and feeding apparatus, taken along the lines 5—5 of FIG. 3.
Figure 6:
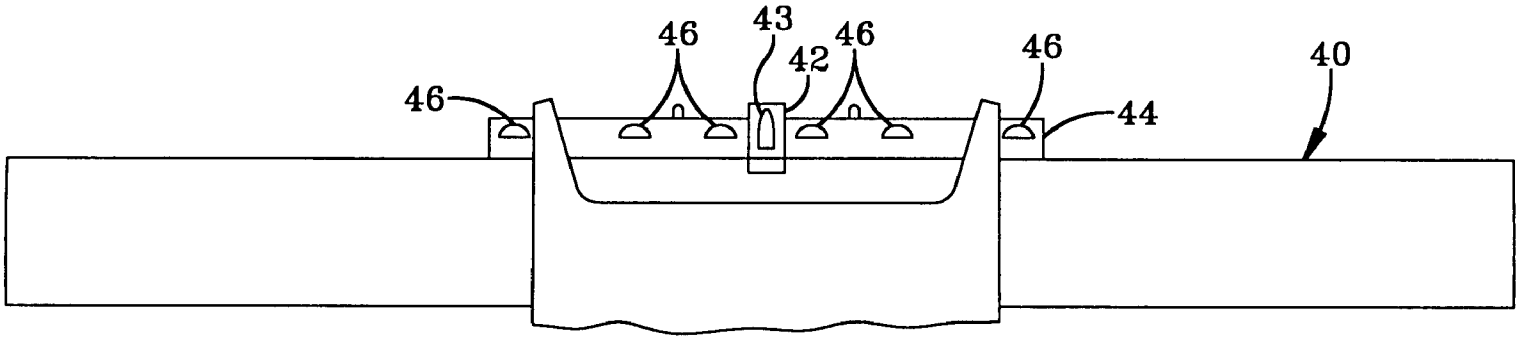
FIG. 6 is an end view of a portion of the receiver sheet supply and feeding apparatus, taken along the lines 6—6 of FIG. 3.

Various aspects of the invention are presented in FIGS. 1–6 which are not drawn to scale and in which like components are numbered alike. Referring now to FIGS. 1–2, a receiver sheet supply and feeding apparatus are shown. The receiver sheet supply and feeding apparatus designated generally by the numeral 10, includes an open hopper 12 and an elevating platform 14 for supporting a stack of sheets. A sheet stack 15 supported on the platform 14 contains individual sheets suitable for serving as receiver sheets for having reproductions formed thereon in a copier or printer device.

The sheet stack-supporting platform 14 is supported within the hopper 12 for substantially vertical elevational movement by a lifting mechanism. The lifting mechanism serves to raise the platform 14 to an elevation for maintaining the topmost sheet in the stack at a predetermined level during operation. Maintaining the topmost sheet at the predetermined level is accomplished by a sheet detection switch 80 (see FIG. 5), or multiple switches, which controls the operation of a motor for actuating the lifting mechanism to raise the platform until a switch or switches is activated.

A sheet feed head assembly 30 is located in association with the hopper 12 so as to extend over a portion of the platform 14 in spaced relation to a sheet stack 15 supported thereon. The sheet feed head assembly 30 includes a ported plenum 32 connected to a vacuum source 31 through a vacuum valve 38, and an airknife 40 connected to a positive pressure air source 41 through a positive pressure valve 60. A positive pressure airjet from the airknife 40 levitates the top sheets in the supported sheet stack 15. Vacuum at the plenum 32 is effective through the plenum ports 33 to cause the topmost levitated sheet from the stack to thereafter be acquired at the plenum 32 for separation from the sheet stack 15. Additional positive air pressure jets from the airknife 40 assure separation of subsequent sheets from the acquired topmost sheet.

A vacuum valve 38 (see FIG. 5) is used to control the operation of the vacuum and to limit the vacuum level. Thus during a feed cycle, the valve will be open so as to levitate the top sheet in the stack. In a preferred method of operation, the opening and closing of the vacuum valve is timing based, however, valve operation may also be controlled by other methods, such as a pressure or a mechanically activated switch. For example, a switch may be attached to the plenum 32 to detect when a sheet has been acquired. A signal provided by the switch on detection of sheet acquisition may be utilized to control operation of various components of the sheet feed head assembly 30, such as timing of activations or setting of air flow levels, to optimize operation for a particular type (size) of sheet to be fed from the sheet supply and feeding mechanism 10. When the vacuum is said to be "actuated", this means that the vacuum valve 38 is open. When the vacuum is said to be "de-actuated" this means that the vacuum valve 38 is closed.

The belts 36 are selectively driven by energizing a feed clutch (not shown), in a direction to remove the acquired sheet from the area above the sheet stack 15 and transport the sheet in the feed direction along a travel path to a downstream transport, such as a driven feed nip roller pair 50. The nip roller pair 50 is driven by a motor. A gear 52 is rotatably mounted on a shaft (not shown) supporting one roller of the nip roller pair 50. A clutch 56 is selectively activated to couple the gear 52 to the shaft 54 for rotation with the shaft. An intermediate gear 58 is in mesh with the gear 52 and a gear (not shown) coupled to one of the belt rollers 39. Accordingly when the clutch 56 is engaged, the belts 36 will be driven so as to feed an acquired sheet such that the acquired sheet is transported from the sheet stack 15 and is thereafter available for any further processing, such as receiving a reproduction from a copier or printer.

The airknife 40 comprises a first air jet arrangement 42 and a second air jet arrangement 44. The first air jet arrangement incorporates a single nozzle 43 in fluid communication with a source of positive pressure air 41, for example a range of 4–10 inwg in certain embodiments. The chambers which are part of the first air jet arrangement 42 and the second air jet arrangement 44 may be separate chambers, or may be combined into one larger chamber. The nozzle 43 directs a positive pressure air stream at the sheet stack, in the center of the lead edge, to fluff the top sheets in the stack to bring the topmost sheet into association with the sheet feed head assembly 30 where it can be acquired by vacuum, at the plenum 32.

The second air jet arrangement 44 incorporates a plurality of nozzles 46 fluid communication with the source of positive pressure air 41. The nozzles 46 are aimed slightly downstream of the aimpoint for the first air jet nozzle 43. The purpose of the second air jet arrangement 44 is to separate any sheets adhering to the topmost sheet acquired by the sheet feed head assembly 30.

A positive pressure air valve 60 is used to control the flow of positive pressure air through the airknife 40. When the positive air pressure separator 40 is actuated, this means the positive air pressure valve 60 is open. When the positive air pressure separator 40 is de-actuated, this means the positive air pressure valve 60 is closed. However, when the positive air pressure valve 60 is closed, that does not necessarily mean that there is no positive pressure airflow. In a preferred design, the positive air pressure valve 60 allows some airflow even when closed (does not close all the way). One commonly used valve design allows about one third of the airflow through an open valve to flow through when the valve is 'closed'.

Common practice for operation of a vacuum corrugated belt feeder with positive air pressure separator during a feed cycle, is to actuate the vacuum valve 38 and the positive air pressure separator 40 at the start of the feed cycle and de-actuated the vacuum valve 38 when the feed clutch is de-energized, but leave the positive air pressure separator 40 actuated throughout the feed cycle.

According to an aspect of the invention, this method is improved upon by pulsing the positive air pressure separator 40 by actuating and de-actuating the positive air pressure separator 40 during the feed cycle.

In a preferred embodiment of the invention, the positive air pressure separator 40 is actuated when the vacuum is actuated, and de-actuated before the feed clutch is energized. According to this aspect of the invention, the positive air pressure separator is actuated during the acquisition phase, and de-actuated during the transport phase.

In a further preferred embodiment, the positive air pressure separator 40 is actuated when the vacuum is actuated, and is de-actuated approximately 50 milliseconds before the feed clutch is energized. This time may be optimized for different operating feed rates, for example it may need to be less for higher speed feeds. By pulsing the positive air pressure separator 40, the high pressure achieved may be higher, and the low pressure (flow when the positive air pressure valve 60 is 'closed') may be lower. This means that during the acquisition phase, when the high pressure is needed to separate the sheets, higher pressure is available. During the transport phase, when higher pressure causes problems, the pressure is lower because the positive air pressure separator 40 is de-actuated. This allows the receiver sheet supply and feeding apparatus 10 to function better for heavier papers, due to the higher pressure during acquisition. It also allows the receiver sheet supply and feeding apparatus 10 to work better for lighter papers, due to the lower pressure during transport. Thus this invention opens the operating window of the receiver sheet supply and feeding apparatus 10. This control may allow the high air level to increase as much as by a factor of two without significantly impacting feed performance on light paper.

Also, on copiers/printers with multiple sheet supplies, this invention enables a smaller blower to do the same job because the positive air pressure separator 40 is not actuated throughout the feed cycle.

According to an aspect of the invention, a method of operating a vacuum corrugated belt feeder with positive air pressure separator during a feed cycle comprises opening the vacuum valve 38 and the positive pressure air valve 60, closing the positive pressure air valve 60, energizing the feed clutch on the belt feeder, de-energizing the feed clutch, and closing the vacuum valve 38.

What is claimed is:

1. In a method of operating a vacuum corrugated belt feeder with positive air pressure separator during a feed cycle wherein said vacuum and said positive pressure air are controlled by a vacuum valve and a positive air pressure valve respectively, wherein the paper is taken away by a belt which is activated when a feed clutch is energized, wherein the vacuum is actuated at the start of the feed cycle and de-actuated when the feed clutch is de-energized, the improvement comprising:

pulsing the positive air pressure separator by actuating and de-actuating said positive air pressure separator during the feed cycle.

2. The method of claim 1 wherein said positive air pressure separator is actuated when said vacuum is actuated, and said positive air pressure is de-actuated before the feed clutch is energized.

3. The method of claim 1 when the feed rate is 110 pages per minute, wherein said positive air pressure separator is actuated when said vacuum is actuated, and said positive air pressure is de-actuated approximately 50 milliseconds before the feed clutch is energized.

4. The method of claim 1 when the feed rate is 110 pages per minute, wherein said positive air pressure valve is closed approximately 50 milliseconds prior to the clutch being energized.

5. A method of operating a vacuum corrugated belt feeder with positive air pressure separator during a feed cycle wherein said vacuum and said positive pressure air are controlled by a vacuum valve and a positive air pressure valve respectively, wherein the paper is taken away by a belt which is activated when a feed clutch is energized, comprising:

opening said vacuum valve and said positive pressure air valve;

closing said positive pressure air valve;

energizing the feed clutch on the belt feeder;

de-energizing the feed clutch; and, closing said vacuum valve.

* * * * *